United States Patent [19]

Maniscalco et al.

[11] Patent Number: 4,495,880

[45] Date of Patent: Jan. 29, 1985

[54] DRAFT ASSISTED DELIVERY SYSTEM

[76] Inventors: Philip M. Maniscalco, New Orleans, La.; Frank Marino, Sands Point, N.Y.

[21] Appl. No.: 379,940

[22] Filed: May 19, 1982

[51] Int. Cl.[3] ..... B63B 35/42

[52] U.S. Cl. ..... 114/123; 114/49; 114/53; 114/230; 114/54; 114/360

[58] Field of Search ..... 114/49, 54, 53, 123, 114/45, 360, 68, 125, 222, 230

[56] References Cited

U.S. PATENT DOCUMENTS

| | | | |
|---|---|---|---|
| 622,232 | 4/1899 | Inglis | 114/222 |
| 1,097,335 | 5/1914 | Koesis | 114/53 |
| 1,309,111 | 7/1919 | Bartlett | 114/53 |
| 1,368,787 | 2/1921 | Graff | 114/53 |
| 3,149,599 | 9/1964 | Francis | 114/53 |
| 3,407,769 | 10/1968 | Hunley et al. | 114/49 |
| 3,847,348 | 11/1974 | Russ | 114/125 |
| 3,915,108 | 10/1975 | Rodriguez | 114/125 |
| 3,915,109 | 10/1975 | Martin | 114/125 |
| 3,928,754 | 12/1975 | Edlund | 114/125 |
| 4,084,529 | 4/1978 | Katernberg | 114/45 |

FOREIGN PATENT DOCUMENTS

| | | | |
|---|---|---|---|
| 1089320 | 11/1967 | United Kingdom | 114/49 |

*Primary Examiner*—Trygve M. Blix
*Assistant Examiner*—Patrick W. Young
*Attorney, Agent, or Firm*—C. Emmett Pugh & Associates

[57] ABSTRACT

A device, a method, and a system for reducing the draft of large vessels to allow the successful navigation of shallow waterways which could not otherwise be traversed due to the depth of the draft of the vessel. The implementation of this system will eliminate unnecessary dredging and facilitate full utilization of the ships' cargo capacity. The system is comprised of several buoyancy modules, control tender vessels, base point grids, appropriate computers, air compressors, and all other necessary equipment. Each buoyancy module of the system consist of two inflatable/deflatable pneumatic lift cells contained by sleeves positioned one at each end, with a base webbing connecting the two ends and forming the middle supportive portion of each module. The base webbing is positioned beneath the vessel oriented so as to position one pneumatic lift cell on each side of the vessel. The base webbing supports the bottom of the ship and after inflation of the pneumatic lift cells, will raise the hull of the ship to reduce its draft. The system utilizes base point grids for properly positioning the vessel in the system and for removal of the vessel from the system. The present invention improves the state of the art by utilizing a plurality of air compressors, pneumatic lift cells, and electronic level indicators in conjunction with one or more computers in an integrated fashion so as to continuously monitor and regulate the vessel's draft, hog, sag, trim and list, by continuously inflating and deflating the lift cells to regulate these conditions.

29 Claims, 16 Drawing Figures

DRAFT ASSISTED DELIVERY SYSTEM

BACKGROUND OF THE INVENTION

1. Field of the Invention

The present invention relates to a practical and commercially feasible method, device and system for reducing the draft of large vessels so as to eliminate unnecessary dredging and to facilitate full utilization of the ship's cargo capacity. The present invention sophisticates and dramatically improves the state of the art by such means as continuously monitoring the ship's draft, hog, sag, trim, and list conditions and providing means to continuously inflate and deflate the lift cells according to these conditions.

2. Description of the Prior Art

U.S. Pat. No. 3,198,157 issued to Amilcas Con Livas entitled "Draft Reducing Device for Vessels" teaches a method and apparatus for reducing the draft of ships when they are leaving or entering a harbor having insufficient water depth for accommodating such sea-going vessels. The draft reducing means of this invention comprises a first bracket means which is adapted to be secured to the sides of the ship and having a portion extended downwardly from an outboard position thereof, a floatable body and a second bracket means secured to the sides of the floatable body and having an extension depending upwardly from an outboard portion thereof; the upper profile of the second bracket means being interlockable with the lower profile of the first bracket. The floatable body of this invention is described as a hollow buoyant body and according to the invention, can be old tankers. The hollow buoyant body contains sea water ballast that can be pumped out to reduce the draft of the vessel.

U.S. Pat. No. 3,171,377 issued to I. A. Livas, entitled "Draft Reducing Device for Vessels" relates to a method and apparatus for reducing the draft of vessels when they are leaving or entering a harbor having insufficient water depth for accommodating such sea-going vessels. The draft reducing adaptor comprises a flexible, inflatable container adapted for receiving air under pressure, attachment means securable to said container and adapted to be fastened to the side of a vessel so that at least a portion of the container is below the water line, and means automaticaly folding the flexible container flatly against the side of the vessel when air is removed from the inflated container. The container is connected to the ship's side at least along one longitudinal line element of the container below the water line and inflating the container before entering the harbor. An attachment device is welded to the ship's side to facilitate coupling the container to the ship. Additionally, a cover member is provided to protect the deflated flexible container from injury both during a sea voyage and while the ship is approaching or is tied up at its dock after negotiating the harbor waters.

U.S. Pat. No. 2,892,434 issued to James Ralleo et al relates to a salvage device for sunken ships, planes or the like and it particularly relates to a salvage device of the inflatable type. The salvage device is a pontoon device comprising inner and outer inflatable bags, said inner bag being partitioned into a series of compartments. The pontoon device comprises a tube extending from the exterior of the pontoon, through the outer bag and the inner bag to permit passage of pressure gas into the bag so as to inflate the pontoon. A plurality of hooks are provided on a fabric strap which securely encircles the pontoon. The pontoon is attached to the side of the ship by means of fastening these hooks to eyelets provided on the side of the vessel.

The rest of the patents are merely representative of what is in the prior art.

GENERAL DISCUSSION OF THE PRESENT INVENTION

The present invention relates to a practical device and system for reducing the draft of vessels.

The Mississippi River, its tributaries and feeder systems comprise 19,000 miles of inland waterways. In this vast American heartland, 60% of the nation's farm products are grown and half of all manufactured goods are produced. Forty percent of the nation's consuming public live and work in this area served by the Port of New Orleans. The Mississippi River is already approximately 100′ deep except for the 21 mile long southwest pass into the Gulf of Mexico and at 9 crossings between New Orleans and Baton Rouge, which have restrictive 40′ depths. Forty foot depths at these critical approaches gives foreign competitors significant trade advantages in world markets. The Port Authority of New Orleans has long contended the need to dredge a 55′ deep channel from Baton Rouge to the Gulf, as the 40′ channel approaches to the Ports of New Orleans and Baton Rouge prevent their efficient utilization by an increasing percentage of ships that must move through these approaches only partially loaded. There simply is no port on the Atlantic or Gulf Coast that has adequate channel depth to accommodate today's large bulk carriers. American exports and imports of grain, coal, and oil, inter alia, which are vital to the American economy, are penalized because the larger, more efficient bulk carriers cannot be fully loaded.

The present invention, called "Draft Assisted Delivery System", or "D*A*D" (trademark of Centurion Seaport Systems Corp.), will not eliminate the need for dredging in the foreseeable future. It will, however, eliminate the need for the amount of dredging required to attain the much sought after 55′ channel, from approximately 12′ of dredging to approximately 3′ of dredging, and it will accomplish the objective years sooner. Although D*A*D system may initially be implemented in the Port of New Orleans, it is highly anticipated that many like ports in the U.S.A. and the world will eventually have some use for D*A*D system. The foreging discussion highlights and accents the need for a practical device and system for reducing the draft of large vessels, while underway, so as to facilitate optimal utilization of these vessels, thereby saving potentially billions of dollars and greatly increasing the efficiency of U.S. and world trade. D*A*D can accomplish all of these purposes without the necessity of fast-track deep dredging legislation.

Up to the present time, it has been the practice to meet such problems by:

(A) Building a new ship of special hauler design; or
(B) Extensively modifying a general purpose ship; or
(C) Reducing the amount of cargo loaded at the beginning of the sea-going voyage; or
(D) Unloading a portion of a fully loaded ship after the sea-going voyage and before entering the harbor until the draft has been sufficiently reduced to permit the ship to enter.

The same solutions have been applied to ships loaded with cargo for sea-going voyages which must cross shallow water within a harbor before reaching the high seas.

Recently, pontoon or container devices have been attempted to be used by means of attaching them to the sides of vessels to reduce their draft. Some of these devices are of the inflatable type. However, nothing in the prior art has been workable in practice and none has received any practical commercial acceptance, thus creating the current dilemma, as aforedescribed.

In accordance with the present invention there is provided draft reducing means for vessels up to 250,000 deadweight tons and above, which is practical and commercially feasible. The present invention employs a series of modules made of high tenacity "space-age" plastic and/or fabric, which is tough, durable, light and easy to handle, and impervious to attach by most chemicals and salt water. Two sleeves on either end of each module encase two inflatable/deflatable pneumatic lift cells. Between the sleeves, the module comprises a base, or webbing, which supports the keel and bottom of the ship which, when properly positioned will, after inflation of the pneumatic lift cells, raise the hull of the ship, to reduce its draft.

Each pneumatic lift cell is of a cylindrical or any other suitable contour and comprises at either outer end flanges. The flanges comprise a plurality of resistive sensors, as will hereinafter be discussed, and a bored and threaded air ingress/egress receptacle for receiving compressed air from air hoses which emanate from floats which are located directly above each module at the surface of the water.

Each float is attached by rope, cable or the like to a corresponding basepoint positioned beyond either side of the ship. The basepoints can be pilings, buoys, or jack-up platforms similar to oil rig platforms, etc. It should be noted that there are two separate and independent grids of basepoints encompassed by the present invention. Two rows or series of basepoints (one row on either side of the vessel) are located in protective waters (e.g., the port harbor) collectively called the incoming vessel basepoint grid. The second network, or grid of basepoints is located at the juncture of the shallow channel with the open seas, and is called the departure basepoint grid, although as will be hereinafter seen, the basepoint grids can be interchangeably used, the terminology being such for purposes of discussion only.

Each float is a steel, or any other suitable material, barge-like flotable container which comprises one or more winches on its upper surface. A series of machine-threaded connector receptacles are provided on the front wall of each float for mating with air hoses leading from a plurality of air compressors mounted on top of a control tender vessel(s) as will be hereinafter described. Tug boats and winches mounted on the floats are utilized, in a synchronized fashion, to properly align the vessel over the modules to facilitate the draft reducing process.

The present invention further comprises one or more control tender vessels which can be any type of supply vessel or work boat, or the like. The control tender vessel(s) carry a computer, a back-up computer, a plurality of conventional air compressors, and a plurality of air regulator control mechanisms. Extending from the air compressors are a plurality of air compressor hoses which are machine-threaded to mate with the connector receptacles provided on the floats.

A flexible air hose is then mated to the air compressor hose terminating in each float so that it extends vertically straight down to mate with the receptacle provided on a flange of the pneumatic lift cell contained in a sleeve of the module which is positioned directly beneath each float.

Extending from the computer and back-up computer mounted on the upper surface of the control tender vessel(s) are electrical wires, which pass through the air regulator control mechanisms and the air compressors and then join the air compressor hoses. The electrical wire further joins the flexible air hose, ultimately terminating into a plurality of resistive sensors dispositioned on the base of each module which is positioned directly beneath each float.

The operation of the invention is as follows:

1. An incoming vessel positions itself between two rows or series of basepoints. The basepoint grid for receiving incoming vessels is called, for strictly illustrative purposes, the incoming vessel basepoint network or grid.

2. The vessel, after being positioned in the incoming vessel basepoint grid, is properly positioned over the webbing, or base of the modules with the aid of tug boats.

3. The winches mounted on to the top surface of each float include a cable which is reeled down and connected to the module directly below. With the aid of the winches mounted on to the top of the floats, the webbing or base of each module can be properly positioned under the hull and bottom of the ship to facilitate proper lifting of the vessel upon inflation of the pneumatic lift cells.

4. A technician on the control tender vessel, or vessels, as there can be one or more, and the vessels can be employed in a variety of configurations, operates a computer mounted on the control tender vessel. First, the technician must input all of the requisite data into the computer. The data would include the ship's beam and length, its current weight, (i.e., loaded weight), depth of the water, etc. Electrical wire emanates from the computer and joins the air hoses leading from the air compressors ultimately connecting with resistive sensors dispositioned on the base of each module. The sensors transmit continuous draft levels and "critical" hog, sag, trim, and list conditions back to the computer. The computer processes all of this data and determines and instructs what amount of air should be compressed into the pneumatic lift cells. The computer dictates this information to air regulator control mechanisms which regulate the amount of compressed air which flows from the air compressors, which can be mounted to either the control tender vessel(s) or to the floats.

5. Now that the webbing, or base of each module is properly positioned beneath the hull and bottom of the ship, covering its entire beam and virtually its entire length, and the technician has inputted all of the requisite data into the computer, the pneumatic lift cells are ready for inflation.

6. The technician on the control tender vessel(s) operates the computer which facilitates transmission of electronic/electrical signals to the air regulation control mechanisms. At this point, the air compressors are turned on. The air is thereby pumped into the pneumatic lift cells in accordance with the computer's instructions so that the cells inflate in a manner such as to facilitate optimal lifting of the vessel, simultaneously minimizing hog, sag, list, and trim difficulties. As the high-pressure air enters the lift cells they naturally attach or "snug" themselves to the sides of the vessel, forming a single, interdependent buoyant unit. The only thing holding them in position there is the high air pressure with the enormous forces of buoyancy that have been generated. When they are deflated, having served their purpose, they will drop off. In a short time, the vessel will have risen to the maximum safe departure draft.

7. The cables which connect the floats to the basepoints are then disconnected. The vessel then proceeds, under its own power, out of the incoming vessel basepoint grid, through the existing channel, until reaches the departure basepoint grid at the juncture of the channel with open seas. The control tender vessel(s) accompany the vessel during its entire journey as it houses the compressors, the air regulation control mechanisms, and the computers. The computers are connected by electrical wires to the resistive sensors on the modules, which continuously transmit "critical" hog, sag, draft, list and trim condition data to the computer. The computer, utlizing the data transmitted by the resistive sensors, will automatically inflate/deflate the cells as so required to prevent any "critical" hog, draft, sag, list and trim difficulties from occurring.

8. Having navigated and cleared the channel, the vessel proceeds to the departure basepoint grid. The vessel is positioned between the two rows or series of basepoints comprised by the departure basepoint grid. Each float is then attached by cable or the like to its corresponding basepoint as previously described within the context of the incoming vessel basepoint grid. Next, the technician on the control tender vessel(s) operates the computer to deflate the lift cells. The vessel quickly settles to its natural draft and departs. The modules settle to the bottom to await engagement to the next inbound vessel. The entire operation is then repeated.

Therefore, the present invention moves the state of the art forward by using modules comprising inflatable/deflatable pneumatic lift cells that automatically attach or "snug" themselves to the sides of the vessel upon inflation, thereby eliminating the necessity of providing attachment means on the sides of the vessel for attachment thereof. The pneumatic lift cells are an integral part of a highly sophisticated fail/safe system, including a computer and back-up computer, for reducing the draft of large vessels in a manner such as to minimize hog, sag, list, and trim difficulties.

For a further understanding of the nature and objects of the present invention, reference should be had to the following detailed description, taken in conjunction with the accompanying drawings, in which like parts are given like reference numerals and wherein:

BRIEF DESCRIPTION OF THE DRAWINGS

FIG. 5*a* is a cross-sectional front view of the module of FIG. 5 which in turn is similar to FIG. 4 but with wire mesh web inserted between the upper and lower portions of the base of the module.

DETAILED DESCRIPTION OF THE PREFERRED EMBODIMENT

Figure 1:
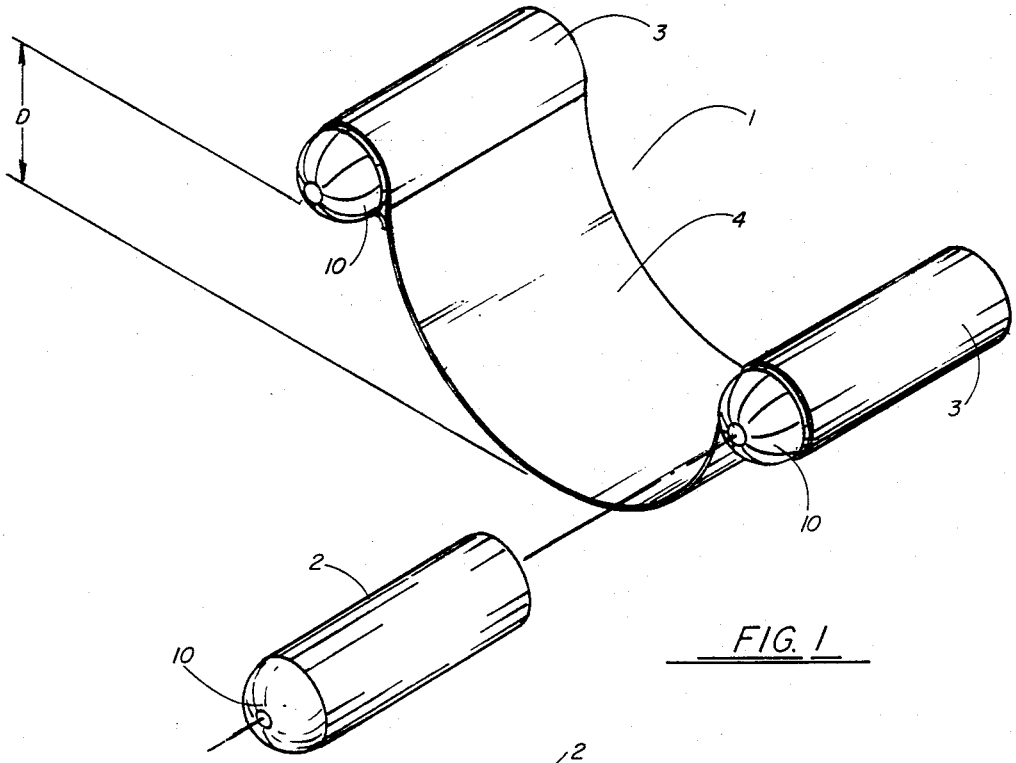
FIG. 1 is a perpsective view of an end module with the pneumatic lift cells inserted into the sleeves thereof.
Figure 2:
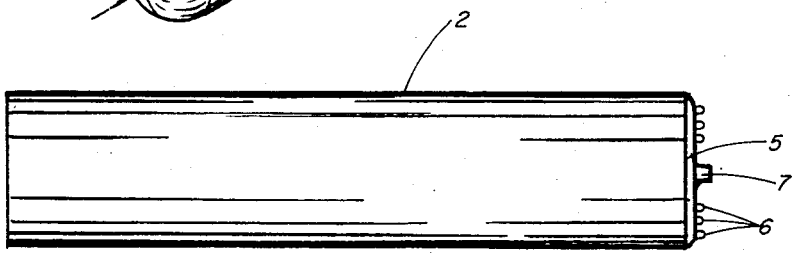
FIG. 2 is a side view of one of the middle module lift cells, in isolation.
Figure 3:
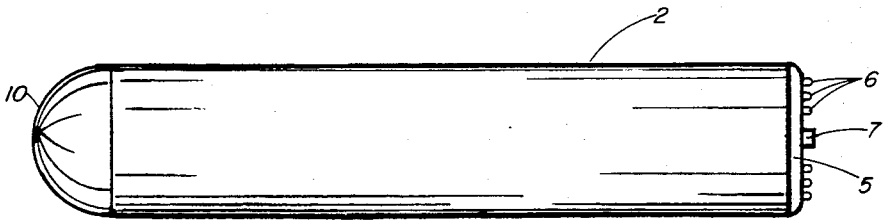
FIG. 3 is a side view of one of the end module lift cells, in isolation.

The present invention employs a series of modules 1 made of high tenacity "space-age" plastic and/or fabric, which is tough, durable, light, easy to handle, and impervious to attack from most chemicals and salt water. As seen in FIG. 1, each module 1 consists of two inflatable/deflatable pneumatic lift cells 2 contained by sleeves 3 dispositioned on either side of each module 1. Between the sleeves 3, the module comprises a base 4, or webbing 4, which supports the keel and bottom of the ship 12, as seen by the phantom lines 50 in FIG. 7, which when properly positioned will, after inflation of the pneumatic lift cells 2, raise the hull of the ship 12, while afloat, to reduce its draft.

Figure 11:
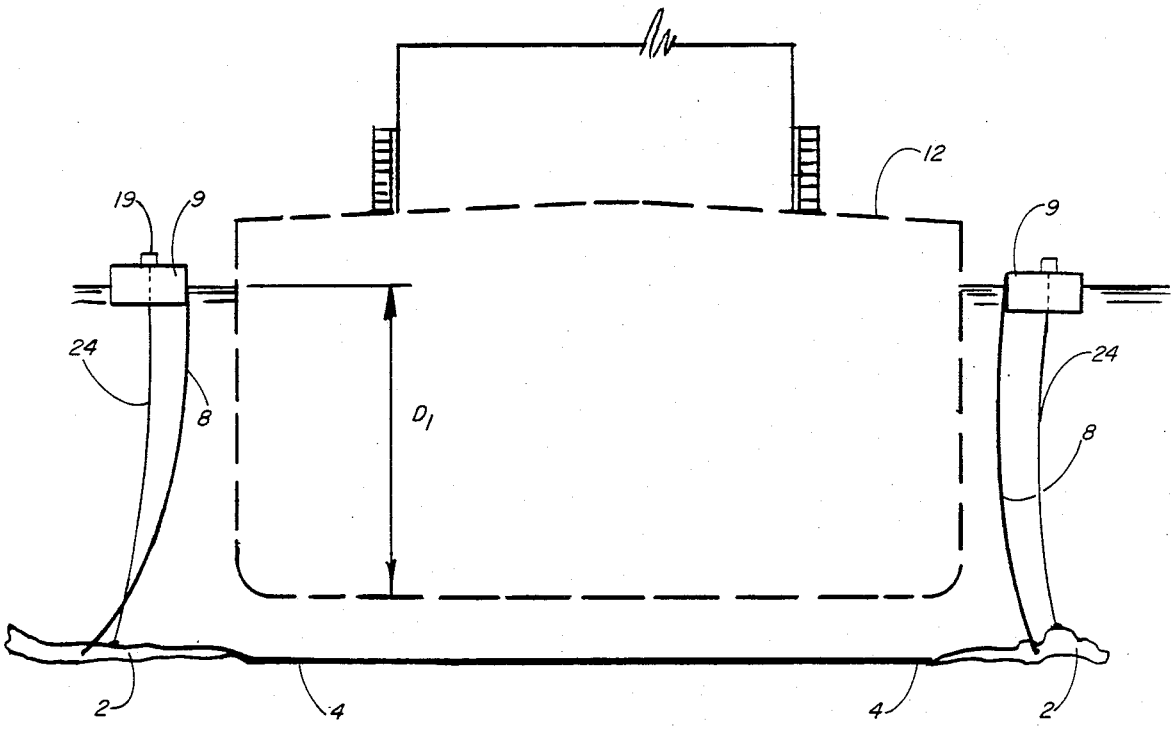
FIG. 11 is an elevated frontal view of the vessel positioned over the modules and between the floats with the lift cells in the deflated inactive condition.
Figure 12:
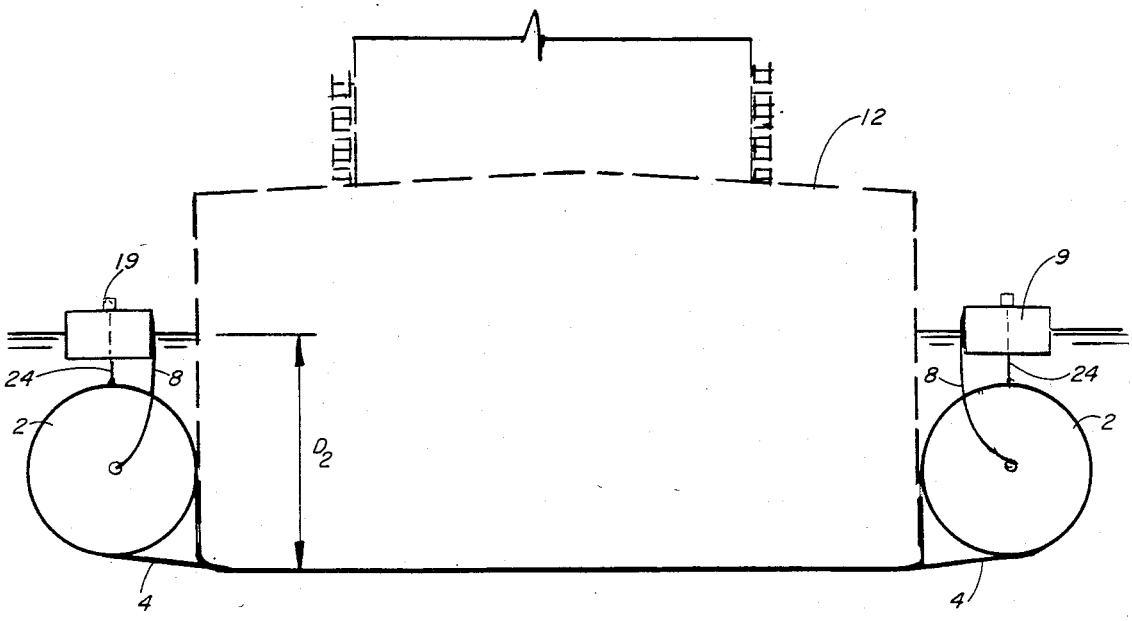
FIG. 12 is an elevated frontal view of the vessel with the pneumatic lift cells inflated and the modules attached to the sides of the vessel.

Each pneumatic lift cell 2 is of a cylindrical or any other suitable contour and comprises, at either outer end, flanges 5. Flanges 5 comprise resistive sensors 6 (as will be hereinafter discussed) and a bored and threaded air ingress/egress receptacle 7 for receiving compressed air from air hoses 8 which emanate from floats 9 which are located directly above each module 1 at the surface of the water, as best seen in FIGS. 11 and 12. The module 1 at each outer end of the series of modules comprises pneumatic lift cells 2 which comprise a semi-hemispherical section 10 on their outer end for streamlining the cell 2 to cut the water resistance upon movement of the vessel 12.

Figure 7:
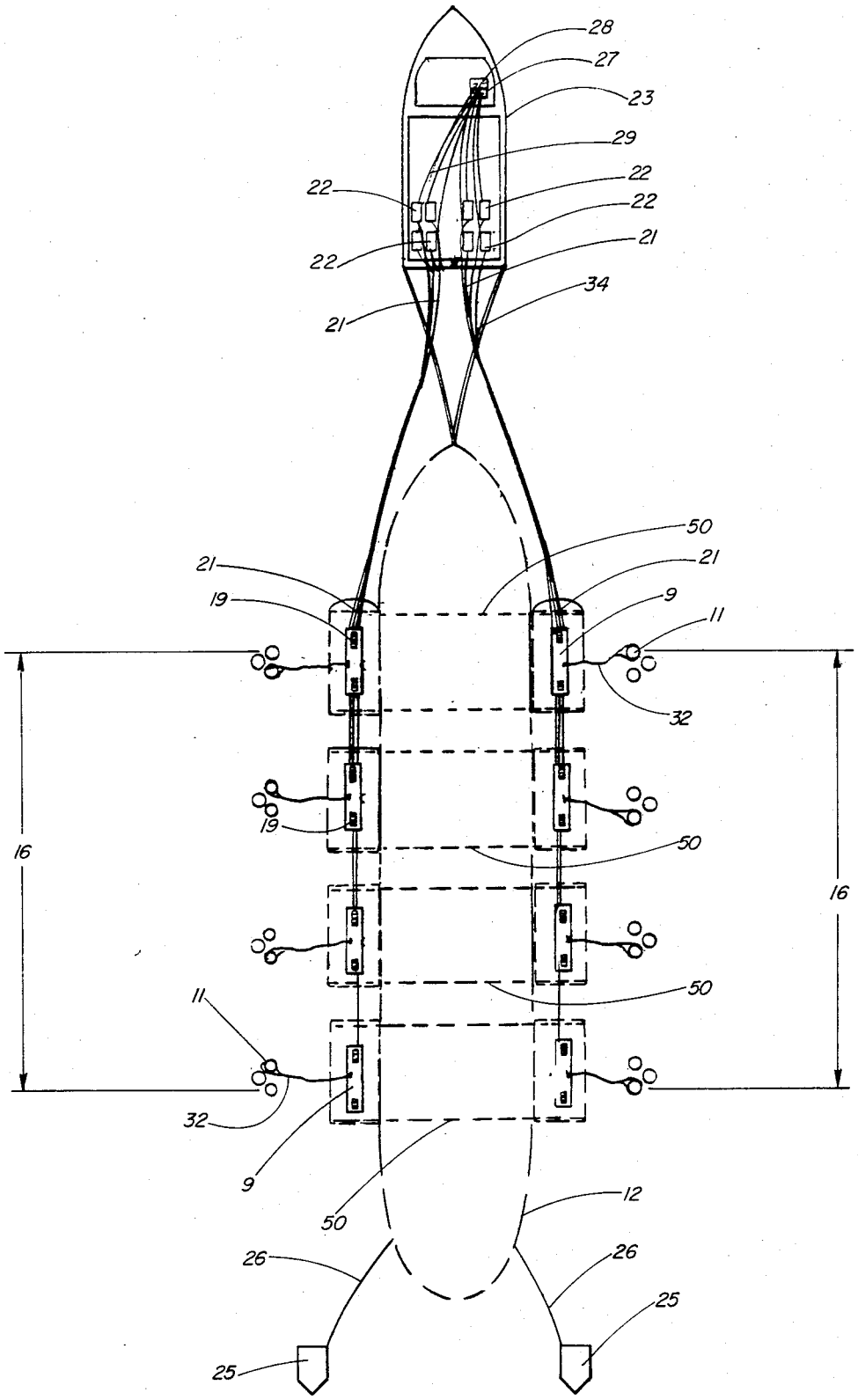
FIG. 7 is a top plan view of the entire system of the present invention, with the cargo vessel positioned within a basepoint grid.
Figure 10:
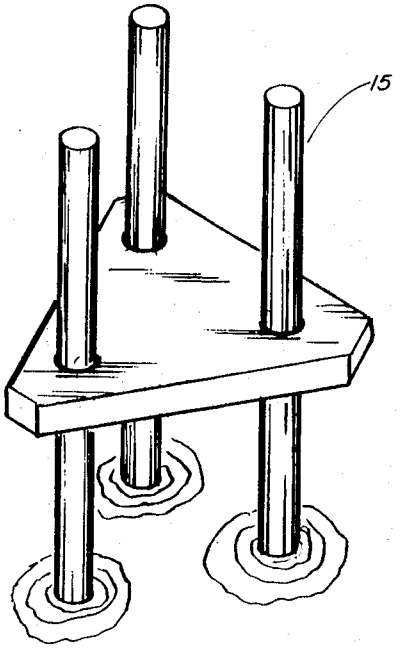
FIG. 10 is a perspective view of jack-up-platform type of basepoint.
Figure 9:
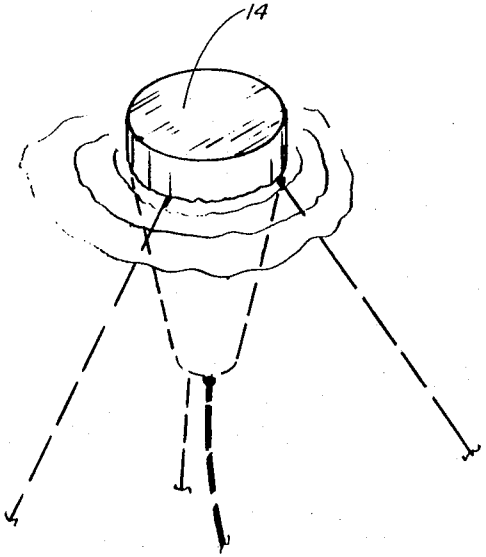
FIG. 9 is a perspective view of buoy type of basepoint.
Figure 8:
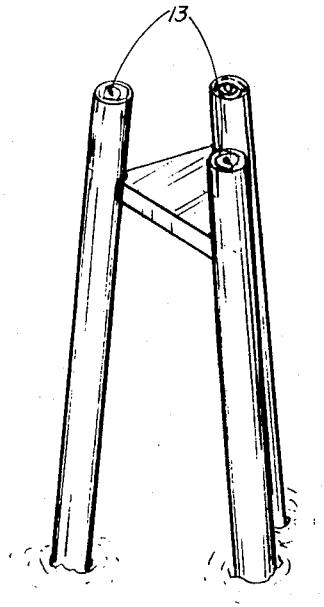
FIG. 8 is a perspective view of pilings type of basepoint.

Each float 9 is attached by rope, cable, etc. 32 to a corresponding basepoint 11 positioned beyond either side of the ship 12, as best seen in FIG. 7. The basepoints 11 can be pilings 13, buoys 14, or jack-up platforms 15 similar to oil rig platforms, or any other suitable device, as seen in FIGS. 8, 9 and 10, respectively. It should be noted that there are two separate and independent grids of basepoints encompassed by the present invention. Two rows or series of basepoints 16 (one row 16 on either side of the vessel 12) are located in protective waters (e.g. the port harbor) and are collectively called the incoming vessel basepoint grid. The second network, or grid of basepoints, is located at the juncture of the shallow channel with the open seas, and is called the departure basepoint grid, although as will be hereinafter seen, the incoming vessel and departaure basepoint grids 17, 18 can be interchangeably used, the terminology being such for purposes of discussion only.

Figure 15:
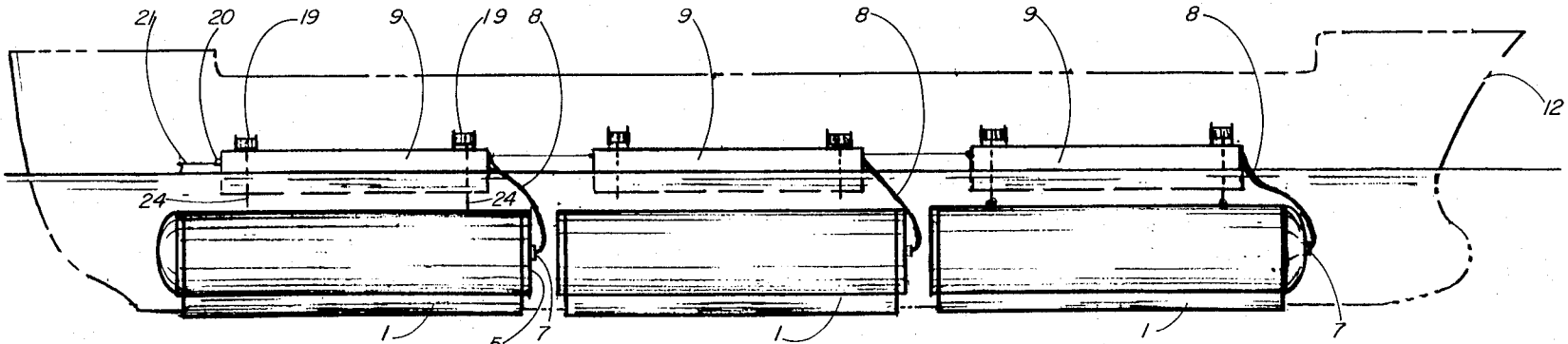
FIG. 15 is a side view of the vessel with the modules attached to the vessel, and with the pneumatic lift cells fully inflated and connected to the floats at the surface of the water directly above.

Each float 9 is a steel, or any other suitable material, barge-like floatable container which comprises one or more winches 19 on its upper surface, as can be seen in FIGS. 7, 11, 12, 13 or 15. A series of machine-threaded connector receptacles 20, as seen in FIG. 15, are provided on the front wall of each float 9 for mating with air hoses 21 leading from a plurality of air compressors 22 mounted on top of a control tender vessel(s) 23, as can be seen in FIG. 7. Optionally, the air compressors 22 can be mounted onto the top surface of the floats 9. Winches 19 mounted on to the top surface of the floats 9 feed cable 24, or the like, down to the modules 1 which are located directly beneath the floats 9 for connection thereto, as best seen in FIG. 15. By this means, the modules 1 can be positioned underneath the vessel 12 in their proper place for lifting (i.e. reducing the draft of) the vessel 12. Also, as seen in FIG. 7, tug boats 25 connected by cable 26 to the vessel 12 can be utilized to properly align the vessel 12 over the modules 1 to facilitate the draft reducing process. Thusly, tug boats 25 shown as phantom lines 50 and the winches 19 on the floats 9 are utilized, in a synchronized fashion, to properly align the vessel 12 with the modules 1 to facilitate the draft reducing process. Additionally, to prevent fore and aft movement of the floats 9 upon movement of the vessel 12, support cables 24 are tautly attached from each float 9, to sleeves 3 of each module 1, thereby maintaining each float 9 in a fixed position above each module 1 as seen in FIG. 15.

Referring now to FIG. 7, the present invention further comprises one or more control tender vessels 23 which can be any type of supply vessel or work boat, or the like. The control tender vessel(s) 23 comprises a computer 27, a back-up computer 28, and a plurality of conventional air compressors 22, and a plurality of conventional air regulator control mechanisms (not shown). Extending from the air compressors 22 are a plurality of air compressor hoses 21 which are machine-threaded to mate with the connector receptacles 20 provided on the front wall of each float 9. The air hoses 21 are of varying lengths so that each air hose 21 terminates in a separate float 9, as best seen in FIGS. 7 and 15. A flexible air hose 8 is then mated to the air compressor hose 21 terminating in each float 9 hose 8 extending downwardly to mate with the receptacle 7 provided on a flange 5 of the pneumatic lift cell 2 contained in a sleeve 3 of the module 1 which is positioned directly beneath each float 9.

Figure 14:
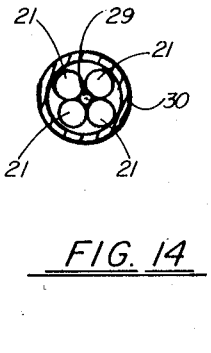
FIG. 14 is a cross-sectional view, taken along section lines 14—14 of FIG. 13, of the encased air compressor hoses and electrical wire which emanates from the control tender vessels and terminates in the floats.
Figure 13:
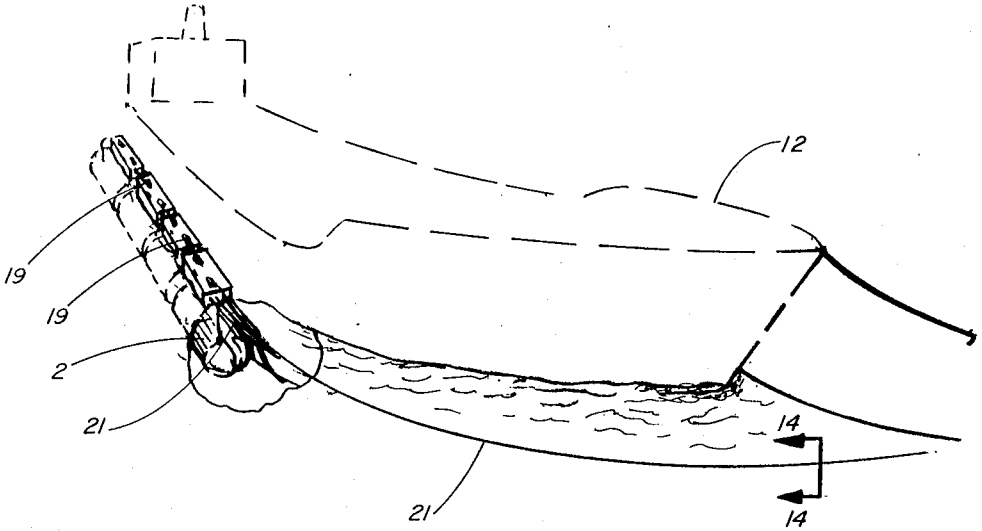
FIG. 13 is an isometric view of the vessel, underway, depicting the air compressor hoses connecting the floats on one side of the vessel with an inset view of the front portion of the foremost pneumatic lift cell, underwater, directly beneath the foremost float.

Extending from the computer 27 and back-up computer 28, mounted on the control tender vessel(s) 23 are electrical wires 29, which pass through the air regulator control mechanisms (not shown), and the air compressors 22 to join the air compressor hoses 21. The electrical wire 29 and the air compressor hoses 21 are snugly encased by a plastic, or any other suitable material, protective casing 30, as seen in cross-section in FIG. 14. The electrical wires 29 further join the flexible air hose 8, terminating into a plurality of electronic resistive sensors 6 for example, SAAB Marine Electronics Level Indicator System, Type SUM-21, the base 4 of each module 1 which is positioned directly beneath vessel 12. The electric wire 29 and the flexible air hose 8 are snugly encased by a plastic, or any other suitable material, protective casing (not shown) similar to protective casing 30.

The operation of the invention is as follows:

1. An incoming vessel 12 positions itself between two rows or series of basepoint 16. This basepoint grid for receiving incoming vessels is called, for strictly illustrative purposes, the incoming vessel basepoint network, or grid.

2. The vessel 12, after being positioned in the incoming vessel basepoint grid, is properly positioned over the webbing, or base 4 each of the modules 1, shown by phantom lines 50, in the series of modules with the aid of one or more tug boats 25, as seen in FIG. 7.

3. As can best be seen in FIG. 15, the winches 19, mounted onto the top surface of each float 9, comprise cable 24 which is reeled down and connected to the module 1 directly below. By means of using the winch 19, the webbing, or base 4 of each module 1 can be properly positioned under the vessel's hull 12 and bottom to facilitate proper lifting of the vessel 12 upon inflation of the pneumatic lift cells 2.

4. As seen in FIG. 7, a technician on the control tender vessel 23, or vessels, as there can be one or more, and the vessels can be employed in a variety of configurations (not shown), operates a computer 27 located on the control tender vessel 23. First, the technician must input all of the requisite data onto the computer 27. The data would include, inter alia, the ship's beam and length, its current weight (i.e. loaded weight), depth of the water, etc. The electrical wire 29 emanates from the computer 27 and joins the air hoses 21 and 8 ultimately connecting with resistive sensors 6 on the base 4 of each module 1. The sensors 6 continuously transmits draft levels and "critical" hog, sag, trim, and list conditions back to the computer 27. Individual draft levels are displayed digitally, while analog readouts provide "critical" hog, sag, list and trim conditions. The computer 27 processes all of this data and determines and instructs what amount of air should be compressed into the pneumatic lift cells 2. The computer 27 dictates this information to air regulator control mechanisms (not shown) which regulate the amount of compressed air which is pumped or fed from the air compressors 22 (which can be mounted to either the control tender vessel(s) 23 or to the floats 9) into the pneumatic lift cells 2.

5. Now that the webbing, or base 4 of each module 1 is properly positioned beneath the ship's hull and bottom, covering its entire beam and virtually its entire length, and the technician has inputted all of the requisite data into the computer 27, the pneumatic lift cells 2 are ready for inflation.

6. The technician(s) on the control tender vessel(s) 23 operates the computer 27, which facilitates transmission of electronic/electrical signals to the air regulator control mechanisms (not shown). At this point, the air compressors 22 are turned on. Air is thereby pumped into the pneumatic lift cells 2 in accordance with the computer's 27 instructions, so that the cells 2 inflate in a manner such as to facilitate optimal lifting of the vessel 12, simultaneously minimizing hog, sag, lift and trim difficulties. As the high-pressure air enters the lift cells 2, they naturally attach or "snug" themselves to the sides of the vessel 12, forming a single, interdependent buoyant unit. The only thing holding them in position there is the high air pressure with the enormous forces of buoyancy that have been generated. When they are deflated, having served their purpose, they will drop off. A short time later, the vessel 12 will have risen to the maximum safe departure draft.

7. The cables 32 which connect the floats 9 to the base points 11 are then disconnected. Vessel 12 then proceeds, under its own power, out of the incoming vessel basepoint grid 17, through the existing channel, until it reaches the departure base point grid 18 at the juncture of the channel with open seas. The control tender vessel(s) 23 accompany the vessel 12 during its entire journey as it houses the compressors 22, the air regulator control mechanisms (not shown), and the computer 27 and back-up computer 28. The control tender vessel(s) 23 is connected to the ship 12 by means of a cable 34 which forms a bridle between the ship 12 and the control tender vessel(s) 23. The computer 27 is, as aforedescribed, connected by electrical wires 29 to resistive sensors 6 which continuously transmit "critical" hog, sag, draft, list and trim condition data to the computer 27. The computer 27, utilizing the data transmitted by the resistive sensors 6 will transmit electrical signals to the air regulator control mechanisms (not shown) to automatically control the air compressors 22, to automatically inflate/deflate the cells 2 in a manner so as to prevent any "critical" hog, draft, sag, list and trim difficulties from occurring.

8. Having navigated and cleared the channel, the vessel 12 proceeds to the departure basepoint grid 18. The vessel is positioned between the two rows or series of basepoints 16 comprised by the departure basepoint grid 18. Each float 9 is then attached by cable 32, or the like, to its corresponding base point 11. Next, the technician on the control tender vessel(s) 23 operates the computer 27 to deflate the lift cells 2. The deflated condition of the lift cells 2 is referred to as the inert state. Vessel 12 quickly settles to its natural draft and departs. The modules 1, which are connected by means of air hoses 21 to the floats 9 which are attached by cables 32 to the basepoints 11, settle to the bottom to await engagement to the next inbound vessel 12. The entire operation is then repeated.

Figure 4:
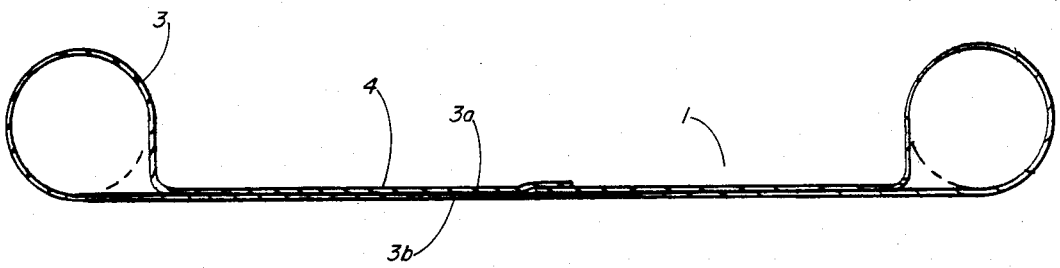
FIG. 4 is a cross-sectional front view of another type of module.
Figure 5:
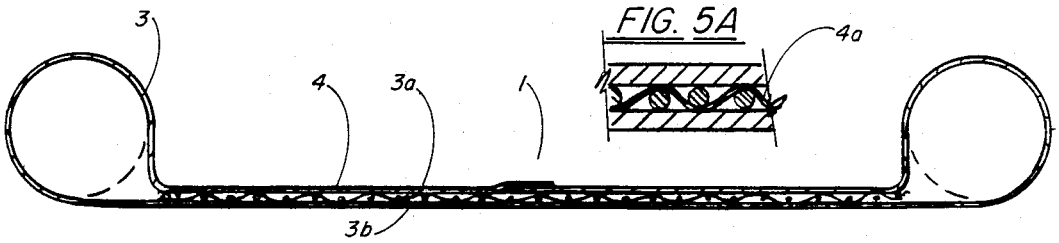
FIG. 5 is a cross-sectional, detailed front view of one type of module.
Figure 6:
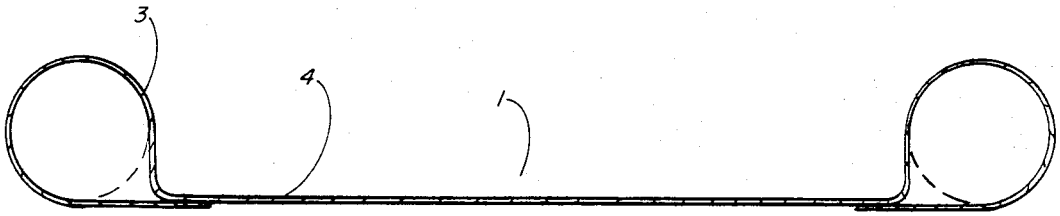
FIG. 6 is a front view of a third type of module.

FIGS. 4, 5 and 6 depict three different types of modules 1. FIG. 4 depicts a continuous sheet of "space-age" plastic or fabric which is overlapped so as to form a base 4 and two sleeves 3, and which is dielectrically seam-welded together. FIG. 5 depicts the same thing as FIG. 4 except that a wire-mesh web 4*a* is inserted between the top 3*a* and bottom 3*b* overlapping portions. FIG. 6 merely shows the sheet of "space-age" plastic formed into module 1 in a non-overlapping manner.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A draft assisted delivery system for reducing the draft of a marine vessel, comprising:

a. at least one control tender vessel disposed adjacent to the marine vessel;

b. air supply means associated with said control tender vessel(s);

c. air regulator means associated with said air supplying means;

d. a computer associated with said air regulator means;

e. at least one inflatable/deflatable module, each module having two, laterally opposed, inflatable/-deflatable pneumatic lift cells with a base extending under the vessel connecting said inflatable/deflatable pneumatic lift cells together;

f. a plurality of surface floating containers disposed above said module(s);

g. a plurality of positioning means mounted on said floating containers for positioning said module(s) about the marine vessel;

h. a plurality of air delivery means emanating from said air supplying means connected to said pneumatic lift cells for facilitating the inflation/deflation thereof;

i. float/module connection means associated with said positioning means on said floatable containers and said module(s) for connecting said floating containers to said module(s); said connection means including support means being tautly attached from each floating container to each module below each of said containers for maintaining each said floating container in a relatively fixed position above each said module;

i. information-transmitting means associated with the system for transmitting relevant hull aspect information concerning the vessel to said computer;

k. utilization means associated with said computer for converting said information concerning the marine vessel into control signals;

l. transmission means for transmitting said control signals from said computer to said air regulator means, said air regulator means utilizing said control signals to regulate said air delivery means into said pneumatic lift cells, to facilitate inflation/deflation thereof, altering the draft of the marine vessel while simultaneously minimizing any full aspect difficulties of the marine vessel;

m. incoming vessel basepoint grid means initially associated with the vessel for initially receiving the marine vessel for draft reducing engagement with said module(s); and n. departure basepoint grid means subsequently associated with the marine vessel located a distance away from said incoming basepoint grid means for receiving the marine vessel for disengagement from said module(s).

2. The apparatus of claim 1, wherein said air supplying means comprise a plurality of air compressors.

3. The system of claim 1, wherein it further comprises an auxiliary back-up computer disposed on said control tender boat(s) adjacent to said computer.

4. The apparatus of claim 1, wherein said electric resistive sensors are disposed on said floatable containers.

5. The system of claim 1, wherein said transmission means comprises insulated electrical wire emanating from said computer and connecting to said air regulator mechanisms.

6. The system of claim 1, wherein insulated electrical wire connects said information transmitting means to said computer.

7. The system of claim 1, wherein each module is made of high tenacity "space-age" plastic and/or fabric, which is tough, durable, light, easy to handle, and impervious to attack from most chemicals in salt water.

8. The system of claim 1, wherein each said pneumatic lift cell is made of high tenacity "space-age" plastic and/or fabric, which is tough, durable, light, easy to handle, and impervious to attack for most chemicals in salt water and which is of a cylindrical or any other suitable contour, and which comprises, at either outer end, flanges.

9. The system of claim 1, wherein the pneumatic lift cells at each outer end comprises a semi-hemispherical section on their outer end streamlining the cell reducing the water resistance of the calls upon movement of the vessel through the water.

10. The system of claim 1, wherein said incoming vessel basepoint grid comprises two rows or series of basepoints, one row on either side of the vessel, located in protective waters.

11. The system of claim 1, wherein said departure basepoint grid means comprises two rows or series of basepoints, one row on either side of a vessel, located at the juncture of the shallow channel with open seas.

12. The system of either one of claims 7 or 8, wherein said basepoint grid means are pilings.

13. The system of either one of claims 6 or 7, wherein said basepoint grid means are buoys.

14. The system of either one of claims 6 or 7, wherein said basepoint grid means are jack-up platforms similar to oil rig platforms.

15. The system of claim 1, wherein each of said floating containers is a barge-like container which comprises one or more cable-carrying winches on its upper surface, and wherein a series of machine-threaded connector receptacles are provided on the front wall of each said float for mating with said air air delivery means leading from said air supplying means mounted on said control tender boat(s).

16. The system of claim 1, wherein said air supplying means comprising a plurality of air compressors mounted on said floating containers.

17. The system of claim 1, wherein said control tender boats are any type of supply vessel.

18. The system of claim 1, wherein said control tender boats are any type of work boat.

19. The system of claim 1, wherein said control tender boats are any type of vessel comprising a computer, a back-up computer, a plurality of air compressors, a plurality of air regulator control mechanisms, and a plurality of air compressor hoses extending from said air compressors.

20. The system of claim 1, wherein said positioning means each includes at least one winch, and said support means includes at least one cable attached to said winch.

21. The system of claim 1, wherein said base is flexible.

22. A draft assisted delivery system for reducing the draft of a marine vessel, comprising:

a. at least one control tender vessel disposed adjacent to the marine vessel;

b. air supplying means associated with said control tender vessel(s);

c. air regulator means associated with said air supplying means;

d. a computer associated with said air regulator means;

e. at least one inflatable/deflatable module, each module having two, laterally opposed, inflatable/-deflatable pneumatic lift cells with a base extending under the vessel connecting said inflatable/deflatable pneumatic lift cells together;

f. a plurality of surface floating containers disposed above said module(s);

g. a plurality of positioning means mounted on said floating containers for positioning said module(s) about the marine vessel;

h. a plurality of air delivery means emanating from said air supplying means connected to said pneumatic lift cells for facilitating the inflation/deflation thereof;

i. float/module connection means associated with said positioning means on said floating containers and said module(s) for connecting said floating containers to said module(s);

j. information-transmitting means associated with the system for transmitting relevant hull aspect information concerning the vessel to said computer; said information transmitting means comprising a plurality of electronic resistive sensors disposed on a sub-system including said floating containers and said module(s);

k. utilization means associated with said computer for converting said information concerning the marine vessel into control signals;

l. transmission means for transmitting said control signals from said computer to said air regulator means, said air regulator means utilizing said control signals to regulate said air delivery means into said pneumatic lift cells, to facilitate inflation/deflation thereof, altering the draft of the marine vessel while simultaneously minimizing the difficulties of the marine vessel;

m. incoming vessel basepoint grid means initially associated with the vessel for initially receiving the marine vessel for draft reducing engagement with said module(s); and n. departure basepoint grid means subsequently associated with the marine vessel located a distance away from said incoming basepoint grid means for receiving the marine vessel for disengagement from said module(s).

23. A draft assisted delivery system for reducing the draft of a marine vessel, comprising:

a. at least one control tender vessel disposed adjacent to the marine vessel;

b. air supplying means associated with said control tender vessel(s);

c. air regulator means associated with said air supplying means;

d. a computer associated with said air regulator means;

e. at least one inflatable/deflatable module, each module having two, laterally opposed, inflatable/-deflatable pneumatic lift cells with a base extending under the vessel connecting said inflatable/deflatable pneumatic lift cells together;

f. a plurality of surface floating containers disposed above said module(s);

g. a plurality of positioning means mounted on said floating containers for positioning said module(s) about the marine vessel;

h. a plurality of air delivery means emanating from said air supplying means connected to said pneumatic lift cells for facilitating the inflation/deflation thereof; each said pneumatic lift cell being made of high tenacity, which is tough, durable, light, easy to handle,, and impervious to attack from most chemicals in salt water and which is of a cylindrical or any other suitable contour, and which comprises, at either outer end, flanges; said flanges including a bored and threaded air ingress/egress receptacle for receiving compressed air from said air air delivery means;

i. float/module connection means associated with said positioning means on said floating containers and said module(s) for connecting said floating containers to said module(s);

j. information-transmitting means associated with the system for transmitting relevant hull aspect information concerning the vessel to said computer;

k. utilization means associated with said computer for converting said information concerning the marine vessel into control signals;

l. transmission means for transmitting said control signals from said computer to said air regulator means, said air regulator means utilizing said control signals to regulate said air delivery means into said pneumatic lift cells, to facilitate inflation/deflation thereof, altering the draft of the marine vessel while simultaneously minimizing any full aspect difficulties of the marine vessel;

m. incoming vessel basepoint grid means initially associated with the vessel for initially receiving the marine vessel for draft reducing engagement with said module(s) and;

n. departure basepoint grid means subsequently associated with the marine vessel located a distance away from said incoming basepoint grid means for receiving the marine vessel for disengagement from said module(s).

24. A draft assisted delivery system for reducing the draft of a marine vessel, comprising:

a. at least one control tender vessel disposed adjacent to the marine vessel;

b. air supplying means associated with said control tender vessel(s);

c. air regulator means associated with said air supplying means;

d. a computer associated with said air regulator means;

e. at least one inflatable/deflatable module, each module having two, laterally opposed, inflatable/-deflatable pneumatic lift cells with a base extending under the vessel connecting said inflatable/deflatable pneumatic lift cells together;

f. a plurality of surface floating containers disposed above said module(s);

g. a plurality of positioning means mounted on said floating containers for positioning said module(s) about the marine vessel;

h. a plurality of air delivery means emanating from said air supplying means connected to said pneumatic lift cells for facilitating the inflation/deflation thereof; said air delivery means including a flexible air hose mated to said air supplying means connected to said floating container said flexible hoses extending downwardly from said floating containers mating with a connector receptacle provided on each pneumatic lift cell contained in said module(s) which is positioned beneath each of said floats;

i. float/module connection means associated with said positioning means on said floating containers and said module(s) for connecting said floating containers to said module(s);

j. information-transmitting means associated with the system for transmitting relevant hull aspect information concerning the vessel to said computer;

k. utilization means associated with said computer for converting said information concerning the marine vessel into control signals;

l. transmission means for transmitting said control signals from said computer to said air regulator means, said air regulator means utilizing said control signals to regulate said air delivery means into said pneumatic lift cells, to facilitate inflation/deflation thereof, altering the draft of the marine vessel while simultaneously minimizing any aspect difficulties of the marine vessel;

m. incoming vessel basepoint grid means initially associated with the vessel for initially receiving the marine vessel for draft reducing engagement with said module(s); and n. departure basepoint grid means subsequently associated with the marine vessel located a distance away fron said incoming basepoint grid means for receiving the marine vessel for disengagement from said module(s).

25. A draft assisted delivery system for reducing the draft of a marine vessel, comprising:

a. at least one control tender vessel disposed adjacent to the marine vessel;

b. air supplying means associated with said control tender vessel(s);

c. air regulator means associated with said air supplying means;

d. a computer associated with said air regulator means;

e. one or more inflatable/deflatable modules, each module having two, laterally opposed, inflatable/-deflatable pneumatic lift cells with a base extending under the vessel connecting said inflatable/deflatable pnuematic lift cells together;

f. a plurality of surface floating containers disposed above said module(s);

g. a plurality of positioning means mounted on said floating containers for positioning said module(s) about the marine vessel;

h. a plurality of air delivery means emanating from said air supplying means connected to said pneumatic lift cells for facilitating the inflation/deflation thereof; electrical wires extending from said computer mounted on said control tender boat(s) and passing through said air regulator control means and said air supply means, connecting to said air delivery means, ultimately terminating into a plurality of resistive sensors disposed on said pneumatic lift cell of said module(s) which is positioned beneath each of said floating containers;

i. float/module connection means associated with said positioning means on said floating containers and said module(s) for connecting said floating containers to said module(s);

j. information-transmitting means associated with the system for transmitting relevant hull aspect information concerning the vessel to said computer;

k. utilization means associated with said computer for converting said information concerning the marine vessel into control signals;

l. transmission means for transmitting said control signals from said computer to said air regulator means, said air regulator means utilizing said control signals to regulate said air delivery means into said pneumatic lift cells, to facilitate inflation/deflation thereof, altering the draft of the marine vessel while simultaneously minimizing any full aspect difficulties of the marine vessel;

m. incoming vessel basepoint grid means initially associated with the marine vessel for initially receiving the vessel for draft reducing engagement with said module(s); and n. departure basepoint grid means subsequently associated with the marine vessel located a distance away from said incoming basepoint grid means for receiving the marine vessel for disengagement from said module(s).

26. The system of claim 25, wherein said electrical wire and said air delivery means are snugly encased by a protective casing.

27. The method of reducing the effective draft of a floating marine vessel, comprising the following steps:

(a) providing a draft assisted delivery system, including— at least one inflatable/deflatable module, each module having two, laterally opposed, inflatable/deflatable pneumatic lift cells with a base extending under the marine vessel connecting said inflatable/-deflatable pneumatic lift cells together, the pneumatic lift cells initially being in a relatively deflated disposition;

a plurality of surface floating containers disposed above said module(s) floating on the water surface;

a plurality of positioning means mounted on said floating containers for positioning said module(s) about the vessel;

float/module connection means connected between said positioning means on said floating containers and said module(s) for connecting them together;

air supply system means associated with said pneumatic cells for inflating and deflating said pneumatic lift cells as desired; and control means associated with said air supply means for controlling the amount of air flow to and air release from said pneumatic lift cells as desired;

(b) positioning the floating marine vessel over the base(s) of said module(s) between said surface floating containers with the relatively deflated pneumatic cells and their associated floating containers positioned to either side of the floating vessel;

(c) activating said positioning means to make taut said float/module connection means and utilizing said control means and said air supply means to inflate said pneumatic lift cells to make them buoyant, causing the module(s) to snug up to the hull of the marine vessel, adding to the buoyancy of the marine vessel and reducing its draft;

(d) after a period of time, loosening said float/module connection means between said floating containers and said module(s) and relatively deflating said pneumatic cells, disengaging said module(s) from the hull of the marine vessel, returning the marine vessel to its natural draft; and (e) separating the marine vessel and said module(s) away from one another.

28. The method of claim 27, wherein there is further included in step "a" the sub-steps of providing sensor means associated with the vessel for measuring the hull aspects of the vessel, and computer means associated with said control means; and in step "c" the sub-step of utilizing the measurement information from said sensor means processed by said computer to control said air supply system means to said pneumatic lift cells to minimize any hull aspect difficulties.

29. The method of claim 28, wherein there is further included the sub-steps of measuring and minimizing any of the vessel's hog, sag, list, trim and draft difficulties.

* * * * *